US008206092B2

(12) United States Patent
Tholen et al.

(10) Patent No.: US 8,206,092 B2
(45) Date of Patent: Jun. 26, 2012

(54) GAS TURBINE ENGINES AND RELATED SYSTEMS INVOLVING BLADE OUTER AIR SEALS

(75) Inventors: Susan M. Tholen, Kennebunk, ME (US); Paul M. Lutjen, Kennebunkport, ME (US)

(73) Assignee: United Technologies Corp., Hartford, CT (US)

( * ) Notice: Subject to any disclaimer, the term of this patent is extended or adjusted under 35 U.S.C. 154(b) by 1443 days.

(21) Appl. No.: 11/950,890

(22) Filed: Dec. 5, 2007

(65) Prior Publication Data

US 2009/0148277 A1 Jun. 11, 2009

(51) Int. Cl.
*F01D 11/08* (2006.01)

(52) U.S. Cl. ..... 415/173.1

(58) Field of Classification Search ..... 415/173.1, 415/173.5, 173.6, 174.5
See application file for complete search history.

(56) References Cited

U.S. PATENT DOCUMENTS 2,859,934 A * 11/1958 Halford et al. ..... 415/115
4,013,376 A * 3/1977 Bisson et al. ..... 415/117
4,247,248 A * 1/1981 Chaplin et al. ..... 415/136
4,573,866 A * 3/1986 Sandy et al. ..... 415/116
4,650,395 A * 3/1987 Weidner ..... 415/116
5,562,408 A 10/1996 Proctor et al.
5,791,871 A 8/1998 Sech et al.
6,315,519 B1 11/2001 Bagepalli et al.
6,393,331 B1 5/2002 Chetta et al.
6,702,550 B2 3/2004 Darkins, Jr. et al.
6,733,235 B2 5/2004 Alford et al.
6,893,214 B2 5/2005 Alford et al.
6,966,752 B2 11/2005 Gieg et al.
6,997,673 B2 2/2006 Morris et al.
2006/0140753 A1 6/2006 Romanov et al.

* cited by examiner

*Primary Examiner* — Nathaniel Wiehe

(57) ABSTRACT

Gas turbine engines and related systems involving blade outer air seals are provided. In this regard, a representative blade outer air seal assembly for a gas turbine engine includes: an annular arrangement of outer air seal segments, each of the segments having ends, the segments being positioned in an end-to-end orientation such that each adjacent pair of the segments forms an intersegment gap therebetween, each intersegment gap being defined, at least partially, by a first recess and a first protrusion, the first protrusion being sized and shaped to be received by the first recess, one of the first recess and the first protrusion being located on an end of a first segment of an adjacent pair of the segments, another of the first recess and the first protrusion being located on an end of a second segment of the adjacent pair of the segments.

19 Claims, 2 Drawing Sheets

GAS TURBINE ENGINES AND RELATED SYSTEMS INVOLVING BLADE OUTER AIR SEALS

STATEMENT REGARDING FEDERALLY SPONSORED RESEARCH AND DEVELOPMENT

The U.S. Government may have an interest in the subject matter of this disclosure as provided for by the terms of contract number F33615-03-D-2345 DO-0009, awarded by the United States Air Force.

BACKGROUND

1. Technical Field

The disclosure generally relates to gas turbine engines.

2. Description of the Related Art

A typical gas turbine engine incorporates a compressor section and a turbine section, each of which includes rotatable blades and stationary vanes. Within a surrounding engine casing, the radial outermost tips of the blades are positioned in close proximity to outer air seals. Outer air seals are parts of shroud assemblies mounted within the engine casing. Each outer air seal typically incorporates multiple segments that are annularly arranged within the engine casing, with the inner diameter surfaces of the segments being located closest to the blade tips.

SUMMARY

Gas turbine engines and related systems involving blade outer air seals are provided. In this regard, an exemplary embodiment of a blade outer air seal assembly for a gas turbine engine comprises: an annular arrangement of outer air seal segments, each of the segments having ends, the segments being positioned in an end-to-end orientation such that each adjacent pair of the segments forms an intersegment gap therebetween, each intersegment gap being defined, at least partially, by a first recess and a first protrusion, the first protrusion being sized and shaped to be received by the first recess, one of the first recess and the first protrusion being located on an end of a first segment of an adjacent pair of the segments, another of the first recess and the first protrusion being located on an end of a second segment of the adjacent pair of the segments.

An exemplary embodiment of a gas turbine engine comprises: a compressor; a combustion section; a turbine operative to drive the compressor responsive to energy imparted thereto by the combustion section, the turbine having a rotatable set of blades; and a blade outer air seal assembly positioned radially outboard of the blades, the outer air seal assembly having an annular arrangement of outer air seal segments with intersegment gaps being located between the segments, each of the intersegment gaps being defined, at least partially, by a first recess and a first protrusion, the first protrusion being sized and shaped to be received by the first recess, one of the first recess and the first protrusion being located on an end of a first segment of an adjacent pair of the segments, another of the first recess and the first protrusion being located on an end of a second segment of the adjacent pair of the segments.

An exemplary embodiment of a blade outer air seal segment comprises: a blade arrival end; a blade departure end; a first recess; and a first protrusion, the first protrusion being sized and shaped to be received by the first recess; one of the first recess and the first protrusion being located on and extending across a width of the blade arrival end, another of the first recess and the first protrusion being located on and extending across a width of the blade departure end.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Gas turbine engines and related systems involving blade outer air seals are provided, several exemplary embodiments of which will be described in detail. In some embodiments, the ends of the outer air seal segments used to form the seals incorporate interlocking features. By way of example, one or more tongues extending from the end of a segment can be received within one or more corresponding grooves of an adjacent segment. This forms a circuitous gas path along an intersegment gap that extends from the inner diameter to the outer diameter of the segments. Configuring the ends in such a manner may tend to reduce distress (e.g., oxidation) of the segments by reducing hot gas ingestion into the intersegment gaps located between the segments.

Figure 1:
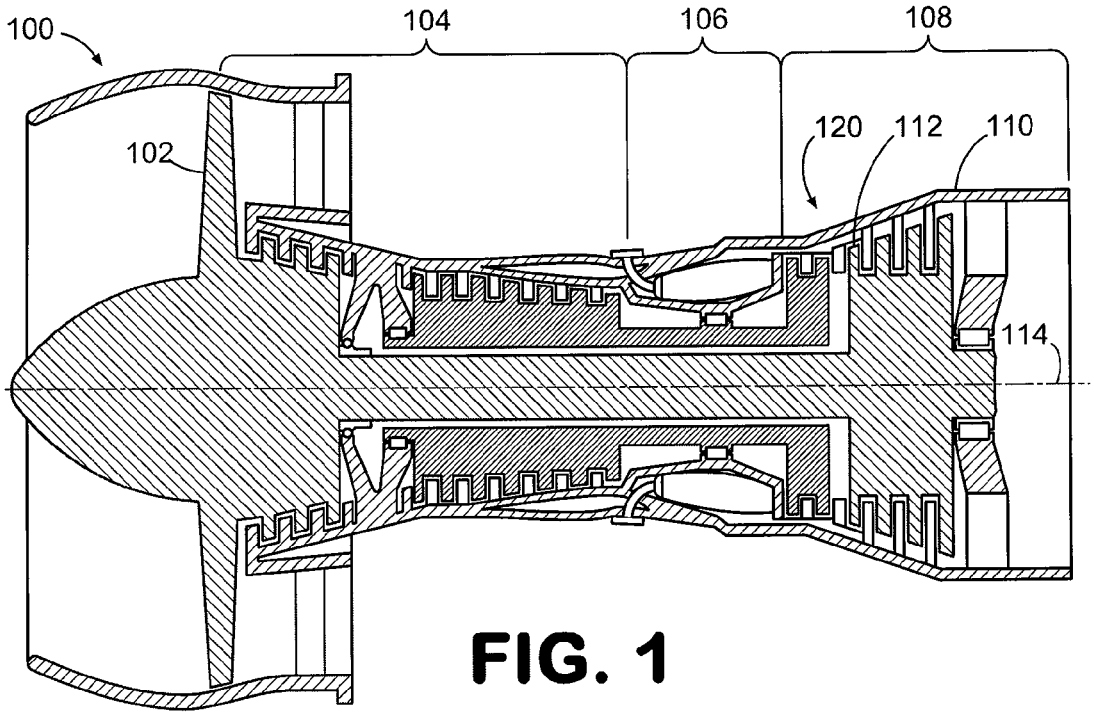
FIG. 1 is a schematic diagram depicting an exemplary embodiment of a gas turbine engine.

Referring now in more detail to the drawings, FIG. 1 is a schematic diagram depicting an exemplary embodiment of a gas turbine engine. As shown in FIG. 1, engine 100 incorporates a fan 102, a compressor section 104, a combustion section 106 and a turbine section 108. Various components of the engine are housed within an engine casing 110, such as a blade 112 of the low-pressure turbine, that extends along a longitudinal axis 114. Although engine 100 is configured as a turbofan engine, there is no intention to limit the concepts described herein to use with turbofan engines as various other configurations of gas turbine engines can be used.

Figure 2:
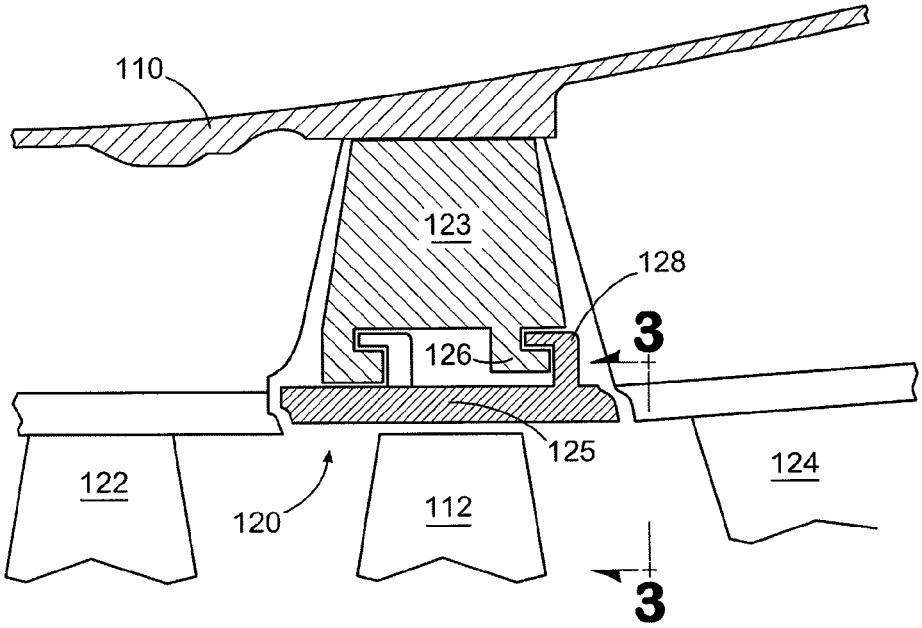
FIG. 2 is a partially cut-away, schematic diagram depicting a portion of the embodiment of FIG. 1.

A portion of engine 100 is depicted in greater detail in the schematic diagram of FIG. 2. In particular, FIG. 2 depicts a portion of blade 112 and a corresponding portion of a shroud assembly 120 that are located within engine casing 110. Notably, blade 112 is positioned between vanes 122 and 124, detail of which has been omitted from FIG. 2 for ease of illustration and description.

As shown in FIG. 2, shroud assembly 120 is positioned between the rotating blades and the casing. The shroud assembly generally includes an annular mounting ring 123 and an annular outer air seal 125 attached to the mounting ring and positioned adjacent to the blades. Various other seals are provided both forward and aft of the shroud assembly. However, these various seals are not relevant to this discussion.

Attachment of the outer air seal to the mounting ring in the embodiment of FIG. 2 is facilitated by interlocking flanges. Specifically, the mounting ring includes flanges (e.g., flange 126) that engage corresponding flanges (e.g., flange 128) of the outer air seal. Other attachment techniques may be used in other embodiments.

Figure 3:
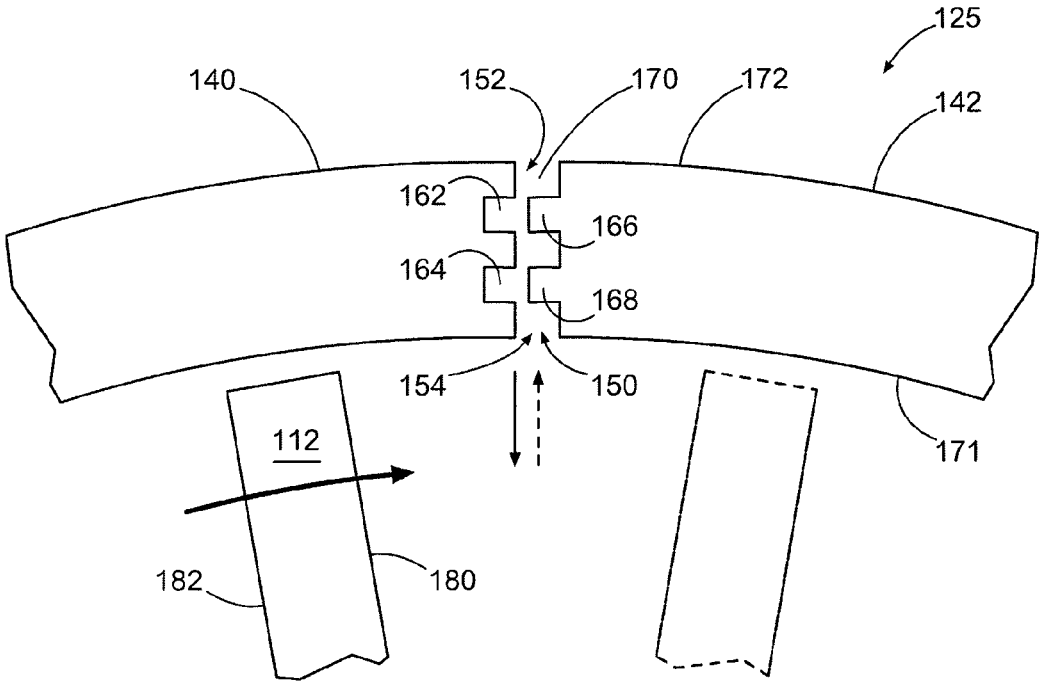
FIG. 3 is a partially cut-away, schematic diagram depicting a portion of the shroud assembly of the embodiment of FIGS. 1 and 2.

With respect to the annular configuration of the outer air seal, outer air seal 125 is formed of multiple arcuate segments, portions of two of which are depicted schematically in FIG. 3. As shown in FIG. 3, adjacent segments 140, 142 of the outer air seal are oriented in an end-to-end relationship, with an intersegment gap 150 located between the segments. Notably, blade 112 is depicted in solid lines, with the direction of rotation of blade 112 being indicated by the overlying arrow. A predicted position of blade 112 after rotating past the intersegment gap is depicted in dashed lines.

Portions defining the intersegment gap include a blade departure end 152 of segment 140 and a blade arrival end 154 of segment 142. Generally, the ends interlock with each other (at least when the components are heated to operating temperatures) with the intersegment gap varying in shape between embodiments.

In this regard, the segments incorporate interlocking features that include a protrusion of one segment and a corresponding recess of an adjacent segment. Notably, the protrusion and recess are provided in a tongue-and-groove configuration in the embodiment of FIG. 3. Specifically, blade departure end 152 of segment 140 includes axial grooves 162, 164 and blade arrival end 154 of segment 142 includes axial tongues 166, 168. The grooves extend axially along the width of end 152 are oriented to receive the tongues, which extend axially along the width of end 154. When the tongues are received within the grooves, a circuitous gas path 170 is formed that extends from the inner diameter 171 of the segments to the outer diameter 172.

The aforementioned configuration may tend to reduce gas ingestion and corresponding distress exhibited by the ends of the segments. Notably, the advancing suction side of each rotating blade (e.g., side 180 of blade 112) tends to promote a radial inboard-directed flow of cooling air (depicted by the solid arrow) from the intersegment gap. In contrast, the retreating pressure side of each rotating blade (e.g., side 182 of blade 112) tends to promote a radial outboard-directed ingestion flow of hot gas (depicted by the dashed arrow) into the intersegment gap. By providing a circuitous gas path along the intersegment gap, ingestion of hot gas may be reduced, particularly into the outboard portions of the gap.

In the embodiment of FIG. 3, the grooves and tongues exhibit generally rectangular cross sections although various other shapes can be used in other embodiments. Additionally, the tongues and grooves are spaced at uniform intervals in FIG. 3 although various other spacings could be used in other embodiments. Further, although two tongues and two grooves are depicted, various other numbers can be used in other embodiments.

FIG. 3 also depicts the adjacent segments 140, 142 in a cold condition, in which the protrusions 166, 168 are not engaged within the corresponding recesses 162, 164. In a hot condition, however, which would be exhibited during operation of the gas turbine engine in which the segments are mounted, the protrusions would be engaged within the recesses. In other embodiments, a degree of engagement between the protrusions and recesses can be exhibited even in a cold condition.

Figure 4:
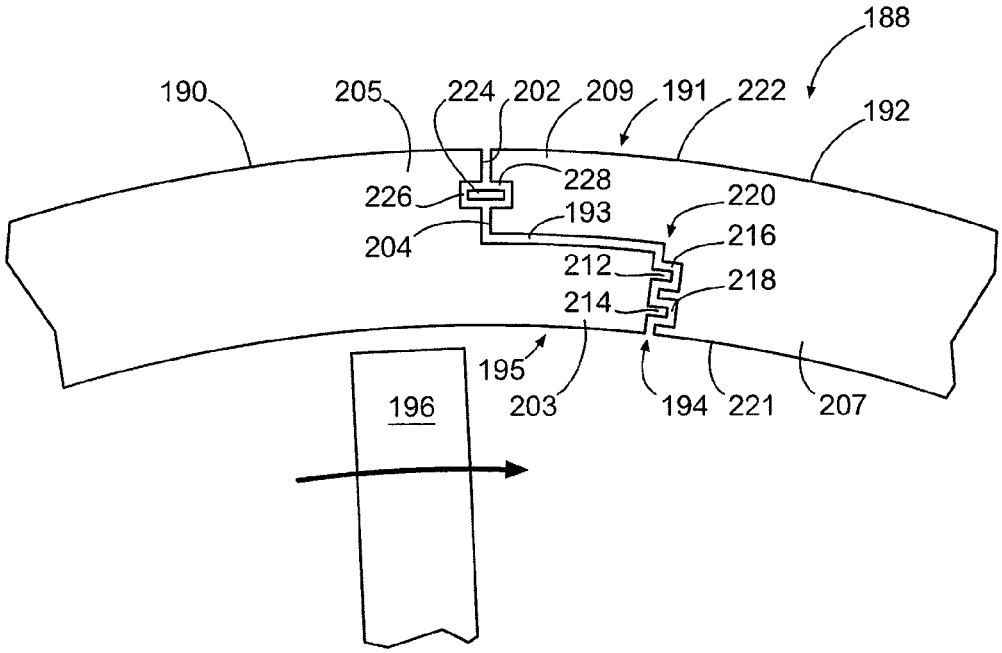
FIG. 4 is a partially cut-away, schematic diagram depicting a portion of another embodiment of a blade outer air seal.

Another embodiment of a blade outer air seal is depicted in FIG. 4, in which the segments are in a hot condition. Specifically, FIG. 4 is a partially cut-away, schematic diagram depicting portions of two adjacent segments of a blade outer air seal 188. As shown in FIG. 4, segments 190, 192 of outer air seal 188 are provided in a ship-lap configuration, in which a portion 191 of segment 192 overlies an outer diameter surface 193 of portion 195 of segment 190. An intersegment gap 194 is located between the segments. Notably, a blade 196 also is depicted, with the direction of rotation of blade 196 being indicated by the overlying arrow.

Portions defining the intersegment gap include a blade departure end 202 of segment 190 and a blade arrival end 204 of segment 192. Due to the ship-lap configuration of this embodiment, each of the ends is formed by more than one end portion, with each such portion extending to a different axial position than an adjacent portion. Specifically, end 202 includes portions 203 and 205, whereas end 204 includes portions 207 and 209.

Generally, ends 202, 204 overlap with each other even during a cold condition. In contrast, interlocking features of ends 202, 204 interlock with each other only when the components are heated to operating temperatures. In this regard, the segments 190, 192 incorporate interlocking features, which are provided in a tongue-and-groove configuration. Specifically, end portion 203 includes axial tongues 212, 214 and end portion 207 includes axial grooves 216, 218. The grooves extend axially along the widths of the respective end portions and are oriented to receive the tongues, which also extend axially along the widths of the respective end portions. When the tongues are received within the grooves, a circuitous gas path 220 is formed that extends from the inner diameter 221 of the segments toward the outer diameter 222. Such a circuitous gas path along the intersegment gap may tend to reduce ingestion of hot gas, particularly into the outboard portions of the gap. Notably, the outboard portions of the gap in the embodiment of FIG. 4 incorporate a feather seal 224 that is seated within recesses 226, 228 of end portions 205 and 209, respectively.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. By way of example, although the embodiments described above include either multiple protrusions or multiple recesses on a given segment end, in other embodiments, combinations of one or more protrusions and one or more recesses can be included on a single segment end. Additionally or alternatively, recesses and protrusions can be discontinuous, such as by forming a checkerboard pattern of protrusions and recesses, for example, with the protrusions and recesses extending axially and radially along a segment end. All such modifications and variations are intended to be included herein within the scope of this disclosure and protected by the accompanying claims.

The invention claimed is:

1. A blade outer air seal assembly for a gas turbine engine comprising:

an annular arrangement of outer air seal segments, each of the segments having ends, the segments being positioned in an end-to-end orientation such that each adjacent pair of the segments forms an intersegment gap therebetween, each intersegment gap being defined, at least partially, by a first recess and a first protrusion, the first protrusion being sized and shaped to be received by the first recess, one of the first recess and the first protrusion being located on an end of a first segment of an adjacent pair of the segments, another of the first recess and the first protrusion being located on an end of a second segment of the adjacent pair of the segments, wherein the first recess extends along an entire width of the end on which the first recess is located, wherein the first protrusion extends along an entire width of the end on which the first protrusion is located.

2. The assembly of claim 1, wherein the outer air seal segments exhibit a ship-lap configuration in which a portion of each of the segments overlies an outer diameter surface of a portion of a corresponding adjacent one of the segments.

3. The assembly of claim 1, wherein the first protrusion is a tongue and the first recess is a groove.

4. The assembly of claim 1, further comprising:

a second recess and a second protrusion, one of the second recess and the second protrusion being located on the end of the first segment of the adjacent pair of the segments, another of the second recess and the second protrusion being located on the end of the second segment of the adjacent pair of the segments.

5. The assembly of claim 4, wherein:

the first recess and the second recess are located on the end of the first segment; and the first protrusion and the second protrusion are located on the end of the second segment.

6. The assembly of claim 1, wherein:

the first recess is rectangular in cross section; and the first protrusion is rectangular in cross section.

7. The assembly of claim 1, wherein each adjacent pair of the segments forms an intersegment gap therebetween when the assembly is heated to an operating temperature.

8. A gas turbine engine comprising:

a compressor;

a combustion section;

a turbine operative to drive the compressor responsive to energy imparted thereto by the combustion section, the turbine having a rotatable set of blades; and a blade outer air seal assembly positioned radially outboard of the blades, the outer air seal assembly having an annular arrangement of outer air seal segments with intersegment gaps being located between the segments, each of the intersegment gaps being defined, at least partially, by a first recess and a first protrusion, the first protrusion being sized and shaped to be received by the first recess, one of the first recess and the first protrusion being located on an end of a first segment of an adjacent pair of the segments, another of the first recess and the first protrusion being located on an end of a second segment of the adjacent pair of the segments, wherein the first protrusion extends along an entire width of the end on which the first protrusion is located, wherein the first recess extends along an entire width of the end on which the first recess is located.

9. The engine of claim 8, wherein each of the intersegment gaps is additionally defined by a second recess and a second protrusion, one of the second recess and the second protrusion being located on the end of the first segment of the adjacent pair of the segments, another of the second recess and the second protrusion being located on the end of the second segment of the adjacent pair of the segments.

10. The engine of claim 9, wherein:

the first recess and the second recess are located on the end of the first segment; and the first protrusion and the second protrusion are located on the end of the second segment.

11. The engine of claim 8, wherein the first protrusion is a tongue and the first recess is a groove.

12. The engine of claim 11, wherein the outer air seal segments exhibit a ship-lap configuration in which a portion of each of the segments overlies an outer diameter surface of a portion of a corresponding adjacent one of the segments.

13. The engine of claim 11, wherein the engine is a turbo fan gas turbine engine.

14. The engine of claim 8, wherein the intersegment gaps are located between the outer air seal segments when the blade outer air seal assembly is heated to an operating temperature.

15. A blade outer air seal segment comprising:

a blade arrival end;

a blade departure end;

a first recess; and a first protrusion, the first protrusion being sized and shaped to be received by the first recess;

one of the first recess and the first protrusion being located on and extending across a width of the blade arrival end, another of the first recess and the first protrusion being located on and extending across a width of the blade departure end.

16. The segment of claim 15, further comprising:

a second recess and a second protrusion, one of the second recess and the second protrusion being located on the blade arrival end, another of the second recess and the second protrusion being located on the blade departure end, the second protrusion being sized and shaped to be received by the second recess.

17. The segment of claim 15, wherein the first protrusion is a tongue and the first recess is a groove.

18. The segment of claim 15, wherein the blade outer air seal segment is configured to engage an identical blade outer air seal segment in a ship-lap configuration.

19. The segment of claim 15, wherein the first protrusion is received by the first recess when the segment is heated to an operating temperature.

* * * * *